United States Patent [19]

Williamson

[11] 4,448,119

[45] May 15, 1984

[54] TOGGLE PRESS

[75] Inventor: Hugh E. Williamson, London, England

[73] Assignee: Hugan Limited, London, England

[21] Appl. No.: 386,831

[22] Filed: Jun. 9, 1982

[30] Foreign Application Priority Data

Jun. 17, 1981 [GB] United Kingdom ..... 8118678

[51] Int. Cl.[3] ..... B30B 1/16

[52] U.S. Cl. ..... 100/231; 72/451; 83/530; 83/630; 100/257; 100/272; 100/286

[58] Field of Search ..... 100/231, 257, 272, 286, 100/53, 269 R; 72/451; 29/251; 83/630, 530

[56] References Cited

U.S. PATENT DOCUMENTS

| | | | |
|---|---|---|---|
| 214,533 | 4/1879 | Straffin | 83/630 |
| 993,916 | 5/1911 | Vogel | 72/451 |
| 1,660,720 | 2/1928 | Osborne | 100/257 X |
| 3,661,008 | 5/1972 | Richardson | 72/451 |
| 4,303,012 | 12/1981 | McGlennon | 100/272 |

*Primary Examiner*—Billy J. Wilhite

*Attorney, Agent, or Firm*—Beveridge, DeGrandi and Kline

[57] ABSTRACT

A toggle press comprises a main frame and a tool holder mounted for reciprocal movement relative to the frame by power means actuating an intermediate toggle arrangement comprising two toggle mechanisms acting in series.

19 Claims, 1 Drawing Figure

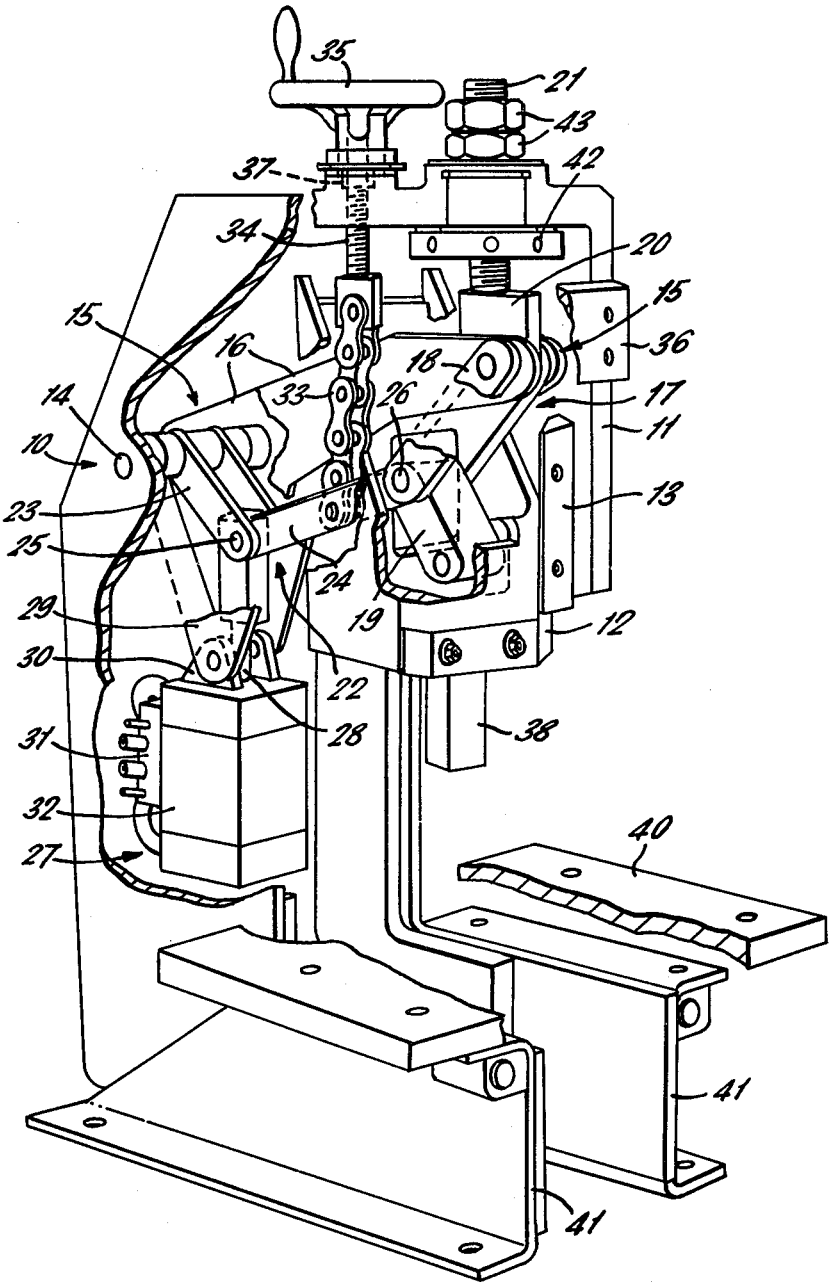
35
21
43
42
37
34
20
15
36
15
16
18
17
14
33
26
11
10
13
23
25
24
29
19
12
30
22
28
38
31
32
40
27
41
41

TOGGLE PRESS

BACKGROUND OF THE INVENTION

1. Field of the Invention

This invention relates to a toggle press.

The concept of the press according to the invention resulted from two happenings some years ago, the first being the inordinately high accident and injury figures in respect of press operatives, attributed to the use of bar operated flypresses, foot operated assembly presses, as well as hand operated mechanical toggle presses (all of which are notoriously difficult to interlock guard and yet to be easily accessible when opened); and the second being the subsequently declared resolve to replace these types of machines with some form of power operated bench press, capable of more efficient guarding with interlocks, and to satisfy the Health & Safety at Work Act 1974, yet still be capable of accepting the huge inventory of existing press tools throughout the country.

Although the term 'power operated' was not specifically defined for design purposes, it was clear that the options available were diverse, i.e. electromechanical (flywheel, clutch), electro-magnetic, hydraulic, hydro-pneumatic and, finally, purely pneumatic.

The last named power source seemed to be eminently preferred, chiefly from the safety aspect, but also from the great flexibility which the medium of compressed air, together with modern control valves, afford to a basic simplistic design.

With all the above in mind, this new press design may draw upon all the latest developments in materials and machine elements, so as to enable one basic design of press frame and pressure mechanism module to be capable of an infinitely variable number of specification permutations as to meet almost any potential user's needs without recourse to the design of a special purpose press 'per se'.

2. Prior Art

It is known to provide a toggle press in which an air ram is employed to straighten a toggle linkage and thereby lower a press tool. In practice, it is arranged for the toggle mechanism to pass slightly beyond the fully straight position but even so if the tool is held in its lowered condition, the pressure will decay.

SUMMARY

According to the invention a toggle press comprises a main frame and a tool holder mounted for reciprocal movement relative to the frame by power means actuating an intermediate toggle arrangement comprising two toggle mechanisms acting in series.

Preferably the intermediate toggle arrangement comprises a first toggle mechanism acting generally parallel to the movement of the tool holder for reciprocating the tool holder and thereby the press tool, and a second toggle mechanism acting generally perpendicularly to the first toggle mechanism for expanding and contracting the first toggle mechanism, which second toggle mechanism is actuated by the power means.

In the preferred embodiment of the invention the main frame is a C-frame and the tool holder is mounted for up and down movement relative to the frame.

The power means is preferably a double-acting air ram. In the case of an air toggle press it is found that if both toggle mechanisms when fully expanded are slightly beyond their respective centre lines, they combine to achieve a positive "hold-on" effect which will only unlock when the air ram is actuated to relax the toggle mechanisms. A press tool held in the tool holder may thus be retained at its bottom position under full pressure for a predetermined period of time.

Preferably the air ram has a cylinder with a pilot operated main valve fixed pick-a-back fashion thereon. Such an arrangement assists a fast operational cycle of the air ram.

Adjustment means may be provided for reducing the effective stroke of the air ram. Such means may act on one of the toggle mechanisms.

It is also preferred that the two toggle mechanisms are carried on a sub-frame which is pivotally mounted on the main frame of the press. Preferably means are provided for adjusting the position of the sub-frame and thereby the extreme operating position of the tool holder and the press tool therein.

Preferably the tool holder is mounted for sliding movement within guide means and shroud plate is provided to prevent an opening in the guide means becoming accessible to the press operative when the tool holder is moved along the guide means during expansion of the toggle mechanisms.

BRIEF DESCRIPTION OF THE DRAWING

The FIGURE is a perspective view, partly cut-away, of an air toggle press.

DESCRIPTION OF THE PREFERRED EMBODIMENT

Referring to the drawing, an air toggle press comprises a main C-frame 10 constructed from a selection of different plate thicknesses, which permits a wide choice of principal dimensions of tool space availability to be obtained consistent with maximum rigidity and safe deflection.

Such details as throat depths, open heights, bed areas and table heights can be obtained to suit any dimensional parameters which might be called for in a replacement or re-equipment programme. Similarly, this also allows for the ready conversion of the basic press to be modified to obtain, for example, a horning press, a deep throat press, an extra height press, a slide feed press, a dial feed press, a numbering press, a hot platen press, a heat seal press, a trimming press etc. To this end, the steel table or bed plate 40 is of bolt-on design allowing for easy removal for the fitting of a horn, bar, or the pressing of tall component assemblies, or for the machining of special blank or scrap clearance apertures.

Additionally the leg channels 41 are welded to the main frame 10 to form a rigid entity. If desired, a pivoted or tilted bed version may be provided by inserting a trunnion and curved slot and lock bolt assembly.

The upper part 11 of the main frame 10 carries a holder 12 for a press tool which in this embodiment is a punch 38. The holder 12 is mounted for vertical sliding movement between a raised position, as shown, and a lowered position, the holder, the stationary guide means 13, provided by the main frame 10, and a shroud plate 36 cooperating to prevent an opening therebetween when the holder moves downwardly thereby avoiding a source of potential danger to the press operative.

Pivotally mounted on a spindle 14 is a sub-frame comprising two parallel bell-crank levers 15. The tool holder 12 is suspended from the top arms 16 of the levers 15 by a vertically acting toggle mechanism 17.

This mechanism comprises a pair of links 18 pivotally connected to the levers 15 and a single shorter link 19 pivotally connected at one end to the links 18 and at its other end to the tool holder 12. When the links 18,19 are expanded, i.e. straightened, the holder 12 and press tool therein are lowered relative to the sub-frame which is held against upward pivotal movement by a spacer block 20 between the levers acting against a bolt 21. Similarly, contraction of the links 18,19 will raise the press tool to its uppermost position. Vertical adjustment of the bolt 21 by means of a tommy bar in a special nut 42 allows the fully lowered position of the press tool to be altered relative to the base plate 40, the bolt 21 then being secured by two lock nuts 43. The sub-frame is thereby pivoted about the axis of the spindle 14 without affecting the toggle mechanism 17.

In order to expand and contract the toggle mechanism 17, there is provided a second generally horizontal toggle mechanism 22 and a double-acting air ram 27. This second toggle mechanism 22 comprises two pairs of links 23, 24 pivotally connected together at 25 and which interconnect the spindle 14 to the common pivot 26 of the links of the first toggle mechanism 17. The common pivot 25 of the second toggle mechanism is connected to the piston rod 28 of the ram 27 which is pivotally mounted on the lower arms 29 of the sub-frame levers 15 by top trunnions 30. A pilot operated main valve 31 is fixed pick-a-back fashion on the cylinder 32 of the ram 27. This arrangement, when provided with a quick exhaust valve and extremely short tube lengths to the cylinder parts, serves to minimise the operational cycle time of the ram. For example 120 strokes per minute at 100 p.s.i. can be achieved.

Extension of the piston rod 28 will expand the second toggle mechanism to straighten the links 23,24 so that they are generally horizontal, which in turn will expand the second toggle mechanism to lower the press tool. In practice, on full extension of the ram 27 whereupon the press tool is in its lowered position, both toggle mechanisms are slightly over their centre lines, e.g. by approximately 1/16 in., which achieves a positive "hold-on" effect which will not decay and only be unlocked when an air impulse is signalled to the cylinder to reverse the sense of the ram. This effect cannot be achieved in a conventional press having a single toggle mechanism operated directly by an air ram, due to its design and the compressability of the air trapped in the cylinder, and the decay of the piston thrust, which allows the single toggle design to unlock involuntarily.

In this embodiment it will be appreciated that the design of the air ram 27 is such that the direction of piston movement having the greater thrust effects downward movement of the press tool. The stroke of the piston is also adjustable by a chain 33 interconnecting a bolt 34 and the longer links 24 of the second toggle mechanism. In this embodiment the chain 33 may be effectively shortened to raise the piston of the ram 27 by rotating a nut 37 held captive on the bolt, the nut being rotatable by a wheel 35.

A single toggle arrangement may have a mechanical advantage of approximately 5:1. The mechanical advantage of this double toggle arrangement in accordance with the invention is in the order of 25:1.

The size and range of power output from the press is determined by the usual pressure versus permitted deflection tolerances generally allowed in blanking presses, and the conventional maximum in working stresses allowed for the various components and the materials used in their design. The possible adjustment of the stroke of the ram 27 permits a finite tonnage output to be obtained with strokes shorter than the maximum stroke available.

The top trunnion mounting of the ram 27 allows it to be readily changed for a ram of a different size.

Whilst an air ram is preferred for cheapness of operation and the "hold-on" effect when combined with the two toggle mechanisms acting in series, other power means, e.g. a hydraulic ram or a mechanical arrangement, may be provided. The provision of the two toggle mechanisms will still give an increased mechanical advantage over a single toggle arrangement.

It will be appreciated that the invention is intended to be applied to a toggle press in which the tool holder is moved vertically up and down. However, as with conventional presses, the press could be supported by a wedge underframe in a position which is inclined to the vertical or provided with a main frame suitable for a horizontally acting press. In each case the tool holder would still be reciprocated by the two toggle mechanisms acting in series.

We claim:

1. A toggle press comprising a main frame and a tool holder mounted for reciprocal movement relative to the frame by power means actuating an intermediate toggle arrangement comprising two toggle mechanisms acting in series, said toggle mechanisms being carried on a sub-frame which is pivotally mounted on the main frame, said press having means for adjusting the position of the sub-frame and thereby the operating position of the tool holder and a press tool therein.

2. A toggle press as claimed in claim 1, wherein the intermediate toggle arrangement comprises a first toggle mechanism acting generally parallel to the movement of the tool holder for reciprocating the tool holder and thereby the press tool, and a second toggle mechanism acting generally perpendicularly to the first toggle mechanism for expanding and contracting the first toggle mechanism, which second toggle mechanism is actuated by the power means.

3. A toggle press as claimed in claim 1, wherein the main frame is a C-frame and the tool holder is mounted for up and down movement relative to the frame.

4. A toggle press as claimed in claim 1, wherein the power means is a double-acting air ram.

5. A toggle press as claimed in claim 4, wherein the air ram and toggle mechanisms are capable of operation so that both toggle mechanisms when fully expanded are slightly beyond their respective centre lines whereby they combine to achieve a positive "hold-on" effect.

6. A toggle press as claimed in claim 4, wherein the air ram has a cylinder with a pilot operated main valve fixed pick-a-back fashion thereon.

7. A toggle press as claimed in claim 4, wherein adjustment means are provided for reducing the effective stroke of the air ram.

8. A toggle press as claimed in claim 7, wherein the adjustment means act on one of the toggle mechanisms.

9. A toggle press as claimed in claim 1, wherein the tool holder is mounted for sliding movement within guide means, and a shroud plate is provided to prevent an opening in the guide means becoming accessible to the press operative when the tool holder is moved along the guide means during expansion of the toggle mechanisms.

10. A toggle press comprising, a main frame, a tool holder mounted for reciprocal movement relative to the main frame, power means for actuating the tool holder, an intermediate toggle arrangement for connecting said power means to said tool holder, said intermediate toggle arrangement comprising two toggle mechanisms connected in series, and a sub-frame pivotally mounted on the main frame, said sub-frame carrying said power means and said intermediate toggle arrangement.

11. A toggle press as claimed in claim 10, wherein the intermediate toggle arrangement comprises a first toggle mechanism acting generally parallel to the movement of the tool holder for reciprocating the tool holder and thereby the press tool, and a second toggle mechanism acting generally perpendicularly to the first toggle mechanism for expanding and contracting the first toggle mechanism, which second toggle mechanism is actuated by the power means.

12. A toggle press as claimed in claim 10, wherein the main frame is a C-frame and the tool holder is mounted for up and down movement relative to the frame.

13. A toggle press as claimed in claim 10, wherein the power means is a double-acting air ram.

14. A toggle press as claimed in claim 13, wherein the air ram and toggle mechanism are capable of operation so that both toggle mechanisms when fully expanded are slightly beyond their respective centre lines whereby they combine to achieve a positive "hold-on" effect.

15. A toggle press as claimed in claim 13, wherein the air ram has a cylinder with a pilot operated main valve fixed pick-a-back fashion thereon.

16. A toggle press as claimed in claim 13, wherein adjustment means are provided for reducing the effective stroke of the air ram.

17. A toggle press as claimed in claim 16, wherein the adjustment means act on one of the toggle mechanisms.

18. A toggle press as claimed in claim 10, wherein means are provided for adjusting the position of the sub-frame and thereby the extreme operating position of the tool holder and the press tool therein.

19. A toggle press as claimed in claim 10, wherein the tool holder is mounted for sliding movement within guide means, and a shroud plate is provided to prevent an opening in the guide means becoming accessible to the press operative when the tool holder is moved along the guide means during expansion of the toggle mechanisms.

* * * * *